US005205146A

United States Patent [19]

Wilkins et al.

[11] Patent Number: 5,205,146

[45] Date of Patent: Apr. 27, 1993

[54] SHEET METAL FORMING TOOL AND METHOD

[75] Inventors: Nicholas H. Wilkins, Yeovil; Frederick B. M. Page, Ravenshead, both of United Kingdom

[73] Assignee: Lawson Mardon (MI) Limited, United Kingdom

[21] Appl. No.: 913,501

[22] Filed: Jul. 14, 1992

[30] Foreign Application Priority Data

Jul. 20, 1991 [GB] United Kingdom ..... 9115717

[51] Int. Cl.[5] ..... B21D 22/10

[52] U.S. Cl. ..... 72/57; 72/54; 72/60; 72/465

[58] Field of Search ..... 72/54, 57, 60, 465

[56] References Cited

U.S. PATENT DOCUMENTS

| | | | |
|---|---|---|---|
| 2,783,728 | 3/1957 | Hoffmann | 72/57 |
| 3,774,430 | 11/1973 | Greer et al. | 72/60 |
| 4,162,625 | 7/1979 | Simmons | 72/54 |
| 4,562,717 | 1/1986 | Shimizu et al. | 72/465 |
| 4,829,803 | 5/1989 | Cudini . | |

FOREIGN PATENT DOCUMENTS

| | | | |
|---|---|---|---|
| 0294034 | 12/1988 | European Pat. Off. . | |
| 0380662 | 12/1989 | European Pat. Off. . | |
| 2251734 | 5/1974 | Fed. Rep. of Germany | 72/465 |
| 0771986 | 11/1982 | Japan | 72/60 |
| 0267028 | 11/1987 | Japan | 72/57 |
| 0015823 | 1/1990 | Japan | 72/465 |
| 602272 | 4/1978 | U.S.S.R. . | |
| 614852 | 7/1978 | U.S.S.R. . | |
| 614854 | 7/1978 | U.S.S.R. . | |
| 615994 | 7/1978 | U.S.S.R. . | |
| 1269885 | 11/1986 | U.S.S.R. . | |
| 1502149 | 8/1989 | U.S.S.R. . | |
| 1349059 | 3/1974 | United Kingdom . | |
| 2145962 | 4/1985 | United Kingdom . | |
| 2208619 | 4/1989 | United Kingdom . | |

*Primary Examiner*—David Jones
*Attorney, Agent, or Firm*—Haugen and Nikolai

[57] ABSTRACT

There is provided a punch for use in cold forming hollow metal articles in a die without wrinkling. The punch is provided with a head portion composed of resiliently deformable material, such as an elastomer, with cavities located in the head portion to permit controlled collapse of the head portion under transverse forces exerted during a forming operation.

13 Claims, 2 Drawing Sheets

SHEET METAL FORMING TOOL AND METHOD

BACKGROUND OF THE INVENTION

I. Field of the Invention

This invention relates to a sheet metal forming tool and to a method of forming sheet metal.

II. Discussion of the Prior Art

The invention may be applicable to forming of containers or of articles of other shapes, e.g., motor vehicle panels. The invention is applicable to any material capable of being cold formed, such as steels and aluminum alloys.

Difficulties are met in forming hollow articles which do not have a constant cross-section, or have angled sides, due to the formation of wrinkles in metal being formed by a punch. This problem is particularly acute in drawing and forming thin steel.

One example where this problem arises is in the drawing and forming of a metal tray having tapered sides. The problem of wrinkling in this field was considered in GB-A-1349059 in relation to aluminum sheet. As explained in that document, one known method of trying to remove wrinkles when producing a hollow article with tapered walls is to use a tapered punch and to provide a resiliently flexible ring in the die. This is unsatisfactory for use with very thin metal, as is now produced by deep drawing techniques.

GB-A-1349059 discloses a more effective arrangement, in which the head of the punch mounts a ring of elastically deformable material. The ring closely fits in the mount of a hollow blank held in the die, but deforms to the tapered shape of the die. This arrangement is much more effective in removal of wrinkles.

One problem with this arrangement is that the deformable ring has to be under compression and the compressive force has to be accurately controlled. Too much resilience or too little resilience will result in a poorly formed article. GB-A-1349059 discloses several ways of providing compression.

In practice, it is difficult with this arrangement to vary and control the compression around the tool for effective production of non-circular articles.

It would be advantageous both in providing for simple manufacture of a punch, as well as to avoid the need for accurate setting of the compressive force, to avoid the necessity for having to control compression.

GB-A-2145962 also considers the problem of wrinkling and also uses an elastic ring which has a specifically controlled shape and a cavity between the ring and a solid core to take up deformed material from the elastic ring. Very careful manufacture and assembly is required for working of this arrangement.

GB-A-2145962 is concerned with manufacture of circular section trays. The problem of wrinkling is much less marked than with manufacture of hollow articles of non-circular section. The provision of a cavity between the ring and the core will not be able to solve the wrinkling problem in hollow articles of rectangular or more complex shape.

The present invention avoids the disadvantages of GB-A-13490569 and GB-A-2145962 and permits manufacture of non-circular articles with improved smoothness and lack of wrinkles, even in corners of the article.

The invention overcomes the wrinkling problem in the cold forming of articles of rectangular section or of irregular sections, as required, for example, in the motor vehicle industry. The invention also permits the cold forming of a hollow article, whose side wall has circumferential steps.

SUMMARY OF THE INVENTION

In accordance with this invention, there is provided a punch for use in shaping a hollow article in a die, the punch having support means, and a head portion mounted on the support means and composed of resiliently deformable material,, characterized in that the head portion comprises a solid mass of said material having interior portions of the mass provided with regions of different resilience from the solid mass, so as to provide predetermined controlled collapse of the head portions under transverse forces.

The regions of different resilience may be provided by means of apertures in the head portion, which takes up flow of the deformable material.

It is also envisaged that rigid members may be provided to reduce collapsibility in selected ares.

DESCRIPTION OF THE DRAWINGS

Reference is now made to the accompanying drawings, where.

DESCRIPTION OF THE PREFERRED EMBODIMENT

Figure 1:
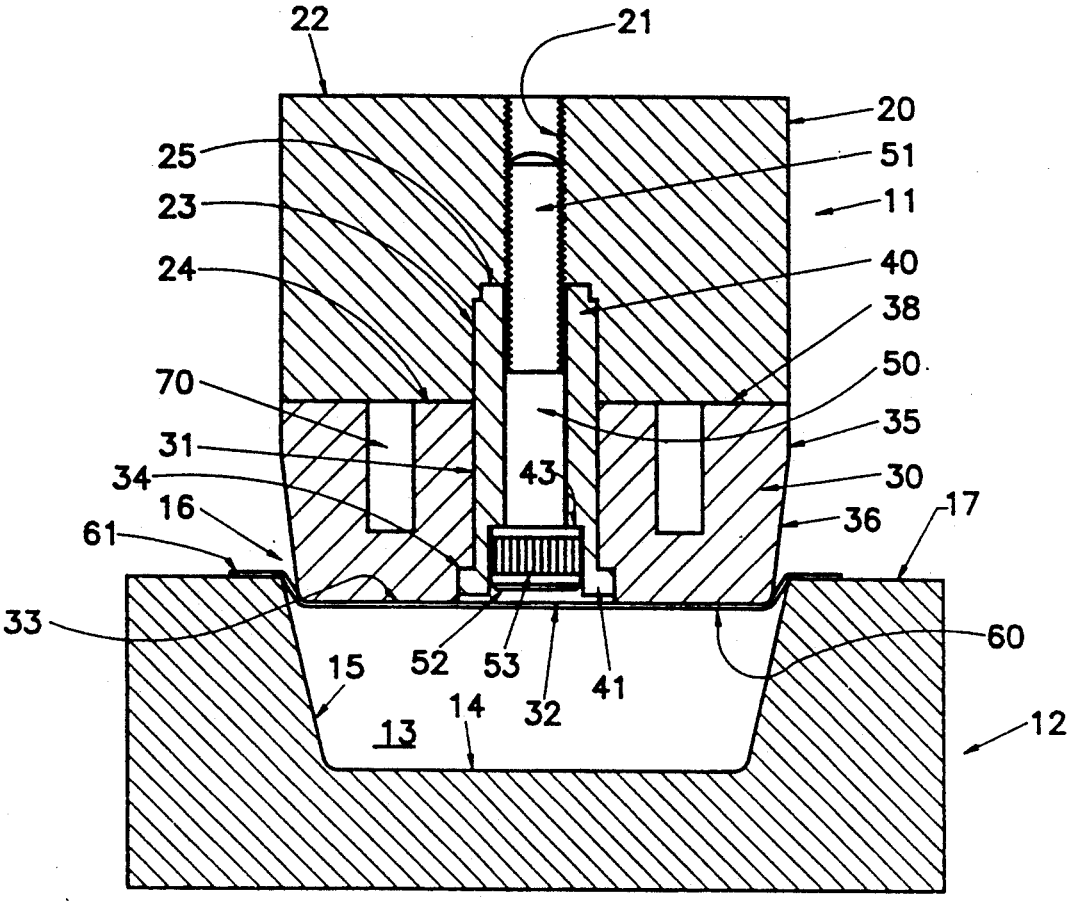
FIG. 1 is a sectional view of a tool, comprising a punch and a die, with the punch just entering the die in a cold forming operation.

FIG. 1 shows a tool having a punch 11 and a die 12. The die is formed with a cavity 13 of generally rectangular section including a flat bottom 14 to the cavity and tapered sides 15, so that the opening 16 in a flat upper surface 17 of the die is of greater dimensions than the flat bottom 14.

The punch comprises a body 20, which is a rectangular section, rigid block. The body 20 has a central threaded bore 21 extending from one end 22 opening into a central recess 23 at the opposite end 24. A shoulder 25 is defined between the bore 21 and the recess 23.

A rectangular section head portion 30 of the punch also has a bore 31 which aligns with the recess 23 and has the same diameter as the recess. A depression 32 at the leading face 33 of the head portion defines a shoulder 34 within the bore 31 of the head portion. A rigid sleeve 40 extends through the bore 31 of the head portion and the recess 23 so as transversely to locate the head portion on the body 20. The sleeve has an outturned flange 41, which is received in the depression 32 and abuts the shoulder 34, defined by the depression. A bolt 50, having a screw-threaded shank portion 51 and a bolt head 52 secures the head portion 30 to the body 20. The bolt is clearly received in the sleeve 40 and the shank 51 is screw engaged in the threaded bore 21 of the body with the bolt head 52 of the bolt engaging a shoulder 43 in the sleeve 40 to consolidate the body and head portion of the punch. The bolt head 52 has a recess with axial splines 53, to permit rotation of the bolt by a tool (not shown) inserted in the bolt head means.

The head portion 30 of the punch has a trailing part 35, adjacent to the body, which has the same transverse dimensions as the body, so that the perimetral wall is coterminous with that of the body. The leading part 36 of the head portion is tapered, with the cross-sectional area reducing towards the leading face 33.

The angle of taper is less than that of the side 15 of the cavity 13 of the die 12. The arrangement is such that, as shown in FIG. 1, the leading face 33 of the head portion 30 closely fits in the opening 16 of the die, with a metal blank 60 located between the head portion and the die.

The head portion 30 is composed of a solid block of an elastomer, for example, polyurethane. The head portion is resiliently deformable and deforms as the head portion is forced into the die cavity in a forming operation.

In operation, a blank 60 of sheet metal is positioned across the opening 16 of the die cavity and the punch 11 is advanced into engagement with the die. The force entered on the blank in a wedge action by the punch is such that the blank is both formed and drawn. The marginal edge 61 of the blank is clamped to the flat upper surface 17 of the die during the drawing operation.

The tool may be mounted in a conventional press for effecting relative movement of the punch and the die, for clamping the blank and for feeding blanks and ejecting formed articles. The press could, for example, be as disclosed in United Kingdom Patent No. 1349059 (incorporated herein by reference) and does not form a part of the present invention.

Figure 2:
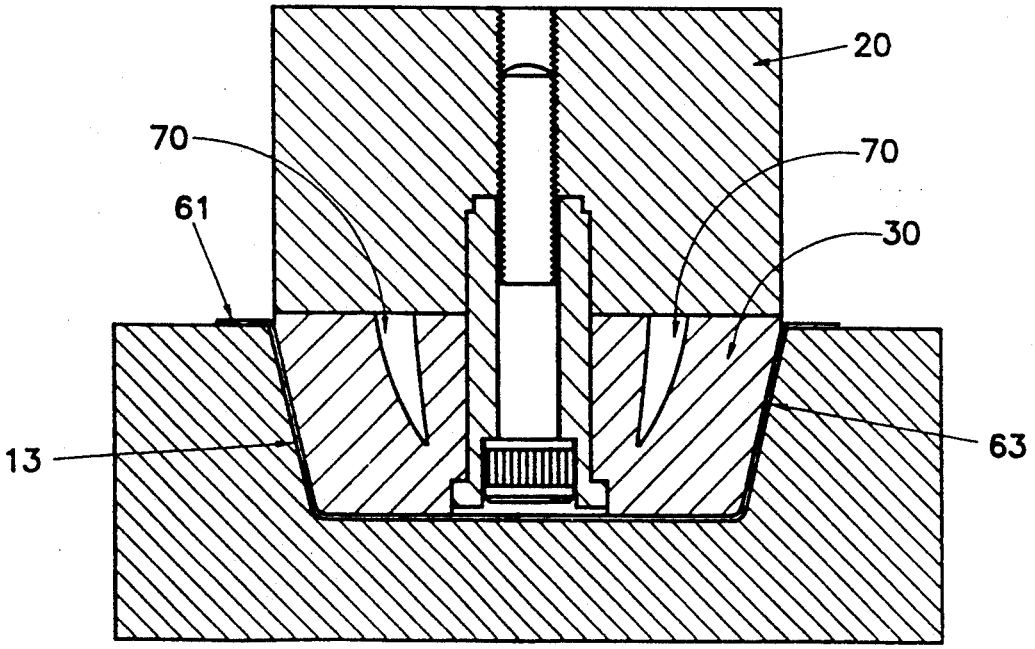
FIG. 2 shows the tool fully engaged in the die with a cold formed hollow article in the die.

Problems with wrinkling of the material of the blank during drawing and forming are caused by uneven pressure being applied to the blank. The present invention overcomes this problem by providing spaced apertures 70 in the head portion 30 of the punch to allow the material of the head portion to flow into the apertures as the head portion is exposed to compressive forces. Partial closure of the apertures 70 is illustrated in FIG. 2, in which the head portion 30 is fully engaged in the cavity 13 to form an article 63 from the blank.

Each aperture 70 is a bore formed in the head portion 30 from the trailing end 38 extruding, in the specific example, axially of the punch. The apertures 70 terminate short of the leading face 33.

Figure 3:
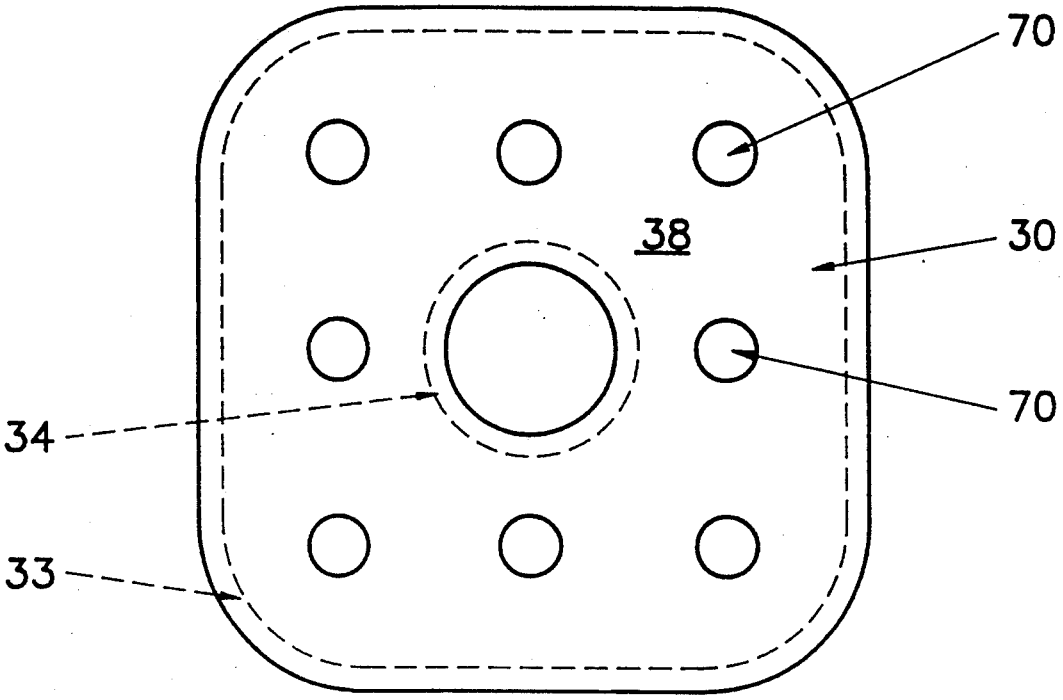
FIG. 3 is a plan view of a head portion of the punch.
Figure 4:
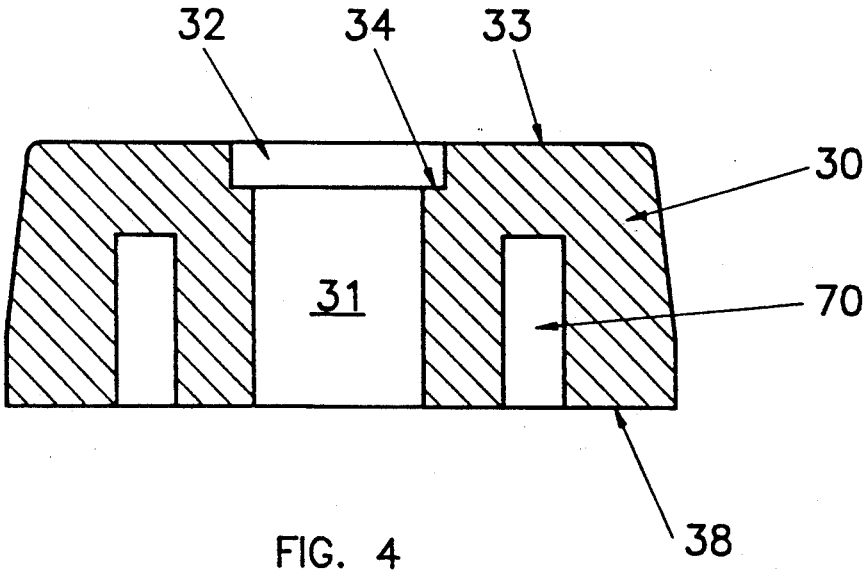
FIG. 4 is a section view of the head portion.

The apertures 70 are evenly spaced around the central bore 31 of the head portion, in FIG. 3, and are evenly spaced from the perimetral wall of the head portion.

The apertures modify the collapse of the head portion at selected regions of the head portion, thereby permitting unwrinkled, complex shapes to be formed, by locating the apertures to provide regions of greater or lesser rigidity where required.

It is also possible to control the selected regional collapse further by filling or partially filling the apertures 30 with a material of different resilience from that of the elastomeric block. Some apertures may be filled, or partially filled, and others left unfilled.

It is envisaged, for example, that metal members may be inserted in selected apertures to provide relatively rigid areas. This is especially useful for increasing rigidity where a corner is to be formed, other areas having reduced rigidity by means of unfilled apertures.

Metal members may be insert molded in the punching head during manufacture, instead of inserting the members in the head portion.

It is also envisaged that the provision of insert molded members could entirely replace the provision of apertures.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A tool for cold forming a hollow article from sheet material, the tool comprising a die having a cavity and a punch having support means and a head portion mounted on the support means and movable to engage in the die cavity for forming the sheet material, the head portion having a leading face and at least one side face, said head portion comprising a solid mass of resiliently deformable material, said solid mass having spaced discrete interior portions of different resilience from the solid mass, said discrete interior portions being spaced from said leading face and said at least one side face and spaced from said support means, whereby reaction forces on the head portion, when the head portion enters the die cavity, cause predetermined controlled collapse of the head portion, whereby cold flow of the sheet material is controlled to prevent wrinkling of said sheet material.

2. A tool according to claim 1, wherein the regions of different resilience comprise apertures formed in the solid mass of said sheet material.

3. A tool according to claim 2, wherein at least some of said apertures are filled, or partially filled with filler materials of different resilience from that of said solid mass.

4. A tool according to claim 3, wherein some of the apertures are filled, or partially filled, with metallic material, and other relatively spaced apertures are unfilled.

5. A tool according to claim 2, wherein the head portion has a trailing face and said apertures extend within the head portion through said trailing face.

6. A tool according to claim 1, wherein the head portion is molded with inserts to said solid mass, the inserts defining said regions of different resilience.

7. A tool according to claim 2, wherein the solid mass of the head portion is composed of an elastomer.

8. A punch for use in shaping a hollow article in a die, the punch having support means, and a head portion mounted on the support means the head portion having a leading face and at least one side face and being composed of resiliently deformable material, characterized in that the head portion comprises a solid mass of said material having spaced discrete interior portions of the mass provided with regions of different resilience from the solid mass, said discrete interior portions being spaced from said leading face and said at least one side face and spaced from said support mean so as to provide predetermined controlled collapse of the head portions under transverse forces.

9. A punch for use in cold forming a hollow article in a die cavity from sheet material, the punch having support means and a head portion mounted on the support means and composed of a solid mass of an elastomer, the head portion having a leading face, an opposite trailing face and side faces, the solid mass of elastomer defining apertures which extend into the interior of the mass from the trailing face without opening at the leading and side faces, the apertures being spaced around the head portion to define portions of reduced resilient deformability than other portions, whereby controlled collapse of the head portion under transverse forces when the head portion engages in a die cavity, prevents wrinkling of the sheet material as it is formed into an article.

10. A punch according to claim 9, including further internal portions of said solid mass of elastomer, spaced from said apertures, being provided with inserts of harder material than the elastomer.

11. A punch according to claim 10, wherein said inserts are provided in apertures in the trailing face of the punch.

12. A punching according to claim 9, wherein at least some of said apertures contain a filler material of different resilience from the elastomer.

13. A method of cold forming a hollow article from sheet material by moving a punch into a die cavity to cold form the sheet material in the die, the method comprising the steps of:

providing the punch with a head portion comprising a mass of resiliently deformable material, said mass having controlled regions of resilience;

providing a die having a cavity formed in a surface thereof of a shape for receiving said head portion;

positioning a piece of sheet material over said surface and cavity;

forcing said head portion of said punch against said sheet material to cold form said sheet material into said die, said regions of resilience allowing said head portion to collapse in a predetermined manner to prevent wrinkling in the article, the controlled regions of resilience being provided by selection from one of (i) defining apertures in the interior of the solid mass, and (ii) providing inserts in the solid mass of different resilience from the material of the solid mass.

* * * * *